United States Patent [19]

Douno

[11] 4,060,093

[45] Nov. 29, 1977

[54] COIN STACKER IN AUTOMATIC COIN WRAPPING APPARATUS

[75] Inventor: Syugo Douno, Himeji, Japan

[73] Assignee: Glory Kogyo Kabushiki Kaisha, Himeji, Japan

[21] Appl. No.: 697,217

[22] Filed: June 17, 1976

Related U.S. Application Data

[63] Continuation of Ser. No. 230,818, March 1, 1972, abandoned.

[51] Int. Cl.[2] ..... G07D 9/06

[52] U.S. Cl. ..... 133/1 A; 53/212; 133/8 A

[58] Field of Search ..... 133/1 R, 1 A, 8 R, 8 A, 133/8 B, 8 C, 8 D; 53/212

[56] References Cited

U.S. PATENT DOCUMENTS

| | | | |
|---|---|---|---|
| 1,443,481 | 1/1923 | Lavigne et al. | 133/8 C |
| 1,632,344 | 6/1927 | Modlin | 133/1 A |

FOREIGN PATENT DOCUMENTS

| | | | |
|---|---|---|---|
| 221,602 | 5/1958 | Australia | 133/1 A |

*Primary Examiner*—Robert B. Reeves
*Assistant Examiner*—Joseph J. Rolla
*Attorney, Agent, or Firm*—Holman & Stern

[57] ABSTRACT

For stacking a predetermined number of coins which are successively supplied prior to wrapping operation, there are provided a preferably odd number of coin guide members which are combined together to define a vertically elongated space therewithin. An adjustment assembly are provided for adjusting the diameter of the inscribed circle of a substantially regularly polygonal cross section of this vertically elongated space according to the diameter of the coins. In another embodiment of this invention, the adjusting assembly is operated through a cam which is turned, perhaps manually, according to the denomination or the class of the coins. There is additionally provided a mechanism for imparting vibratory motion to the above combined coin guide members in order to ensure the neat stacking of the coins.

15 Claims, 11 Drawing Figures

COIN STACKER IN AUTOMATIC COIN WRAPPING APPARATUS

This is a continuation of application Ser. No. 230,818 filed Mar. 1, 1972, now abandoned.

BACKGROUND OF THE INVENTION

This invention relates to improvements in automatic coin wrapping apparatus designed to wrap up a predetermined number of coins in a neat stack for the sake of convenience in handling. In particular, the invention is directed to a novel and improved coin stacker which is adjustable according to the diameter of the coins.

For the neat stacking of coins of various denominations and hence of various diameters, it is necessary to correspondingly vary the diameter of a substantially cylindrical space in which the coins are stacked. In automatic coin wrapping apparatus of prior design, this requirement has been met, for example, by the provision of a plurality of such substantially cylindrical spaces with diameters predetermined to suit all the possible coin diameters. The selective use of the means defining these substantially cylindrical spaces having the various diameters causes much inconvenience, especially when the apparatus must handle a number of kinds of coins, as is required today. Moreover, this measure makes the overall apparatus unnecessarily bulky and expensive.

SUMMARY OF THE INVENTION

Accordingly, it is an object of the present invention to provide a novel and improved coin stacker comprising a plurality of coin guide members so combined that the diameter of the inscribed circle of the substantially regularly polygonal cross section of a vertically elongated space defined thereby is easily and accurately adjustable to suit all the diameters of coins to be stacked therein.

Another object of the invention is to provide a coin stacker wherein a suitably large number of coin guide members are provided to cause the cross section of the space defined thereby to approximate a complete circle, thereby making possible the neat stacking of coins therein.

Still another object of the invention is to provide a coin stacker wherein the space in which coins are stacked is defined by an odd number of blades to prevent the coins from being held vertically between two oppositely positioned coin guide members which would be parallel to each other if the number of the blades were even.

A further object of the invention is to provide a coin stacker of the character referred to in combination with means for imparting vibratory motion thereto, which facilitates the neat stacking of the coins.

A further object of the invention is to provide a coin stacker of the character referred to incombination with means for adjusting the space defined by the coin guide members according to the denomination or the class of coins to be stacked therein.

A further object of the invention is to provide a coin stacker which can be easily installed in and removed from its operative position in automatic coin wrapping apparatus.

With these objects in view, the present invention provides, in automatic coin wrapping apparatus for wrapping a predetermined number of coins in a stack, a device for stacking successively supplied coins, comprising a plurality of coin guide members combined together to define a vertically elongated space therewithin, the vertically elongated space having a substantially regularly polygonal cross section, diameter adjusting means for controllably varying the diameter of the inscribed circle of said substantially regularly polygonal cross section of said vertically elongated space according to the diameter of the successively supplied coins, and support means for adjustably supporting the coin guide members in the combined form.

The novel features which are considered as being characteristic of this invention are set forth in the appended claim. The invention itself, however, together with additional objects and advantages thereof, will be best understood from the following detailed description taken in connection with the accompanying drawings.

DETAILED DESCRIPTION

Figure 1:
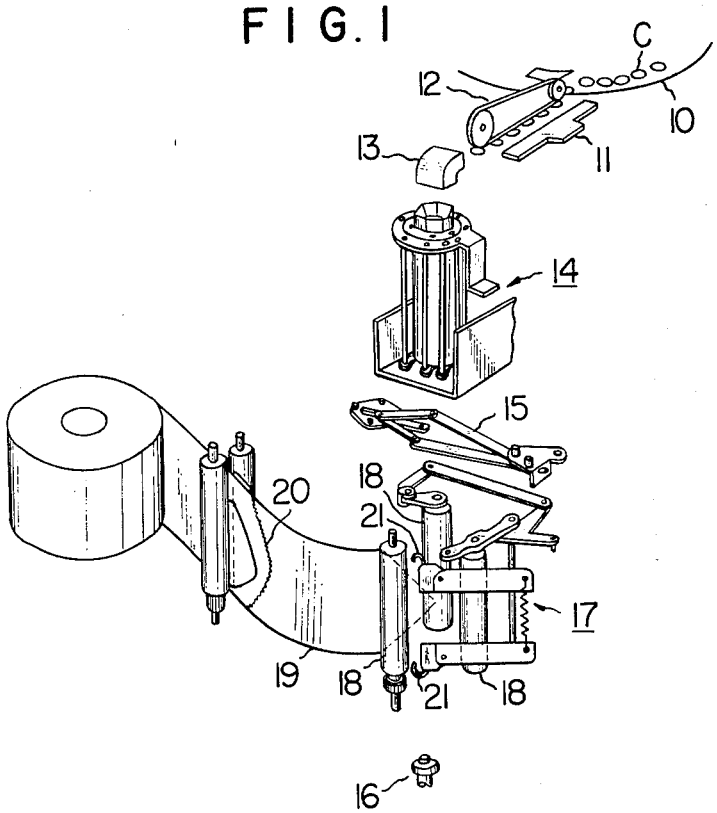
FIG. 1 is a schematic perspective view showing some operative components of automatic coin wrapping apparatus by way of explnation of a mode of use of a coin stacker according to the present invention.

By way of explanation of a mode of use of a coin stacker according to this invention, automatic coin wrapping apparatus of known design will first be described with reference to FIG. 1. Coins C on a rotary disc 10 are successively centrifugally delivered onto a coin passage 11 and are moved therealong by an endless belt 12. On their way to a guide 13, those of the coins of a smaller diameter than the predetermined coin diameter may be automatically removed through an opening, not shown, formed suitably in the coin passage 11. A counter, not shown, is also provided on the coin passage 11 to release only a prescribed number of coins into a coin stacker 14 through the guide 13. The coin stacker 14 shown here is constructed in accordance with the present invention.

Since a shutter 15 at the bottom of the coin stacker 14 is now assumed to be closed, the coins are successively stacked horizontally in the substantially cylindrical space within the coin stacker 14. When the desired number of coins have been thus dully stacked, the motion of the endless belt 12 is automatically stopped, while the shutter 15 is opened by cam means or the like not shown in the drawing. The coins are then supported on a movable guide rod 16 which has been elevated to the level of the bottom of the shutter 15. As the guide rod 16 is succeedingly lowered into coin wrapping means 17, the coins are held among a plurality of rollers 18. The leading end of a continuous strip of wrapping paper 19 is now caught between the stack of coins and one of the rollers. By the rotation of these rollers the wrapping paper is coiled on the periphery of the stack of coins, and is severed off the continuous strip by a cutter 20 owing to its own tension thus exerted.

A pair of movable hooks 21, positioned at the top and the bottom of the stack of coins, are simulataneously operated to tightly fold the side edges of the wrapping paper on the ends of the coins. Since the guide rod 16 is retracted to the position illustrated in FIG. 1 at the instant when the coins are caught among the rollers 18, the duly wrapped stack of coins is dropped downwardly when released by these rollers. For uninterrupted coin wrapping operation, the shutter 15 may be closed as soon as the coins are delivered to the coin wrapping means 17 by the guide rod 16.

Figure 2:
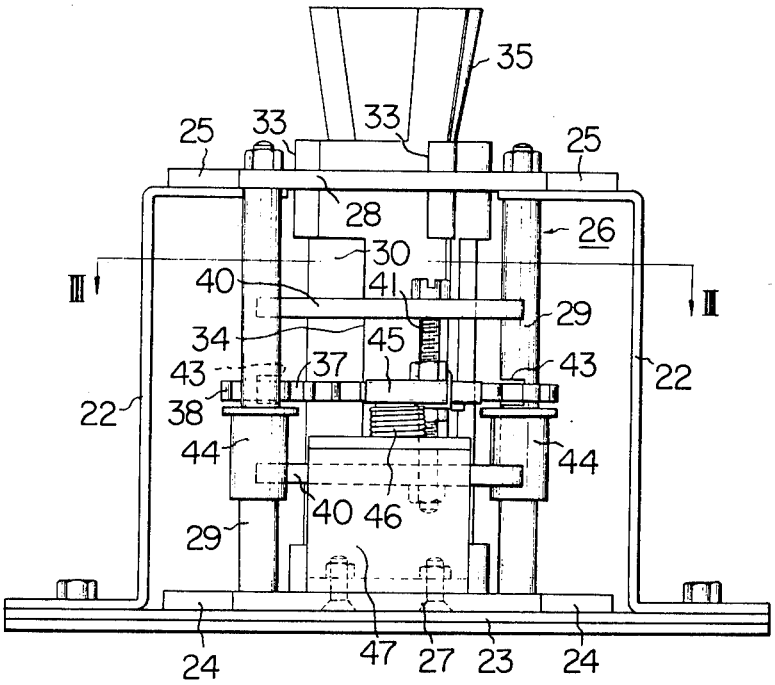
FIG. 2 is a side elevational view of a preferred embodiment of the invention.
Figure 3:
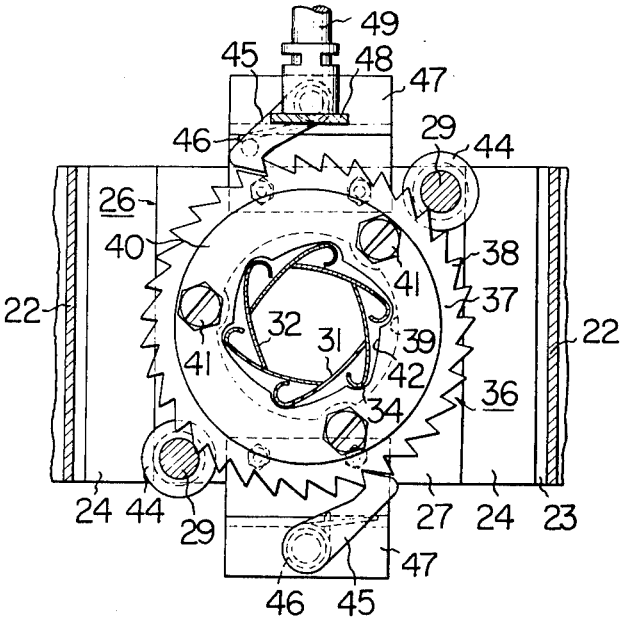
FIG. 3 is a horizontal sectional view taken along the plane of line III—III in FIG. 2.

An example of the coin stacker 14 shown in FIG. 1 is illustrated in greater detail in FIGS. 2 and 3 by way of a first preferred embodiment of this invention. A pair of frame members 22 stand vertically upwardly on a base 23. The upper ends of these frame members 22 are bent toward each other to delimit a certain spacing therebetween. A pair of lower parallel guides 24 are fixedly mounted on the base 23, while a pair of upper parallel guides 25 are fixedly mounted on the bent upper ends of the frame members 22. It will be noted that the spacings between these respective pairs of lower and upper parallel guides 24 and 25 are each greater than the aforesaid spacing between the bent upper ends of the frame members 22.

Framework 26 more directly associated with the coin stacker includes a lower frame member 27 positioned between the lower parallel guides 24, an upper frame members 28 positioned between the upper parallel guides 25, and two posts 29 extending vertically between the opposite corners of the lower and the upper frame members 27 and 28. A plurality, six in this particular embodiment, of coin guide members each having a vertically elongated coin-guide surface 30 of resilient material such as, for example, steel, extend vertically through the centers of the lower and the upper frame members 27 and 28. These six coin guide members 30 are combined in such a manner that their inside edges 31 contact the inside surfaces 32 of the adjoining blades, thereby defining a vertically elongated space therewithin which is substantially regularly hexagonal in cross section, as shown in FIG. 3.

In order to prevent the rotation of the thus combined coin guide members 30 relative to the frame work 26, their outside edges 33 are resiliently fitted in recesses, not shown, formed suitably in the lower and the upper frame members 27 and 28. Each of the coin guide members 30 is made wider at its portions passing through the centers of the lower and the upper frame members. Outside edges 34 of the narrower mid-portions of the coin guide members 30 are folded on the outside surfaces of the adjoining coin guide members 30, as best shown in FIG. 3. The upper portions of the coin guide members 30, projecting upwardly of the upper frame member 28 as seen in FIG. 2, are each made further smaller in width, and are so combined as to form a substantially funnel-shaped hopper 35.

Means for adjusting the diameter of the inscribed circle of the substantially regular hexagon defined by the coin guide members 30 (hereinafter referred to as the "diameter adjusting means"), generally indicated by the numeral 36, is provided for the coin guide members 30. This diameter adjusting means 36 includes a ratchet wheel 37 having a number of teeth 38 on its periphery and a central aperture 39 through which extend the coin guide members 30 with suitable clearance. A pair of cam wheels 40 are mounted above and below the ratchet wheel 37 by means of a plurality of bolts 41 extending vertically therethrough. As illustrated in FIG. 3, each of these cam wheels 40 has a cam face 42 so shaped that when the cam wheels are revolved, for example, clockwise as viewed in FIG. 3, the outside edges 34 of the coin guide members 30 are pressed inwardly to reduce the diameter of the inscribed circle of the hexagonally combined coin guide members 30.

The periphery of the aforesaid ratchet wheel 37 is received in recesses 43 formed in the post 29 and is supported by flanged sleeves 44 mounted thereon. Clips 45 energized by torsion springs 46 for engaging the teeth 38 on the ratchet wheel 37 at substantially diametrically opposite points thereof are mounted on supports 47 fixedly mounted on the lower frame member 27. For imparting vibratory motion to the coin guide members 30, the upper frame member 28 may be provided with a member 48 which is connected through a link 49 to means such as an electric motor not shown in these drawings.

In the first preferred embodiment of this invention constructed substantially as hereinbefore described, the ratchet wheel 37 and the cam wheels 40 are turned by a suitable method, either manual or mechanical, to adjust the diameter of the inscribed circle of the substantially regular hexagon defined by the coin guide members 30 according to the diameter of the coins to be stacked. Thereafter, the coins are successively dropped as aforesaid into the space within the coin guide members 30 through the hopper 35, thus horizontally overlying one upon another on the shutter at the bottom of the blades. The neat stacking of the coins is ensured, on the one hand, by the vibratory motion imparted to the coin guide members 30 through the link 49, and on the other hand, by the fact that the coins contact the inside surfaces 32 of the preadjusted coin guide members at as many as six points in this embodiment of the invention.

Although the diameter adjusting means 36 is subject to the expansive force of the coin guide members 30 tending to rotate the same in one direction, this rotation is prevented by the clicks 45 engaging the teeth 38 on the ratchet wheel 37. As a predetermined number of coins are thus duly stacked within the coin guide members 30, the shutter 15 described with relation to FIG. 1 is opened to send the coins out to the succeeding step of wrapping operation. It will be understood that the diameter adjusting means 36 may be revolved only clockwise as viewed in FIG. 3. In this manner the recesses on the cam faces 42 will receive the outside edges 34 of the adjoining coin guide members when the diameter adjusting means 36 has been revolved through a predetermined angle to minimize the diameter of the inscribed circle.

Figure 4:
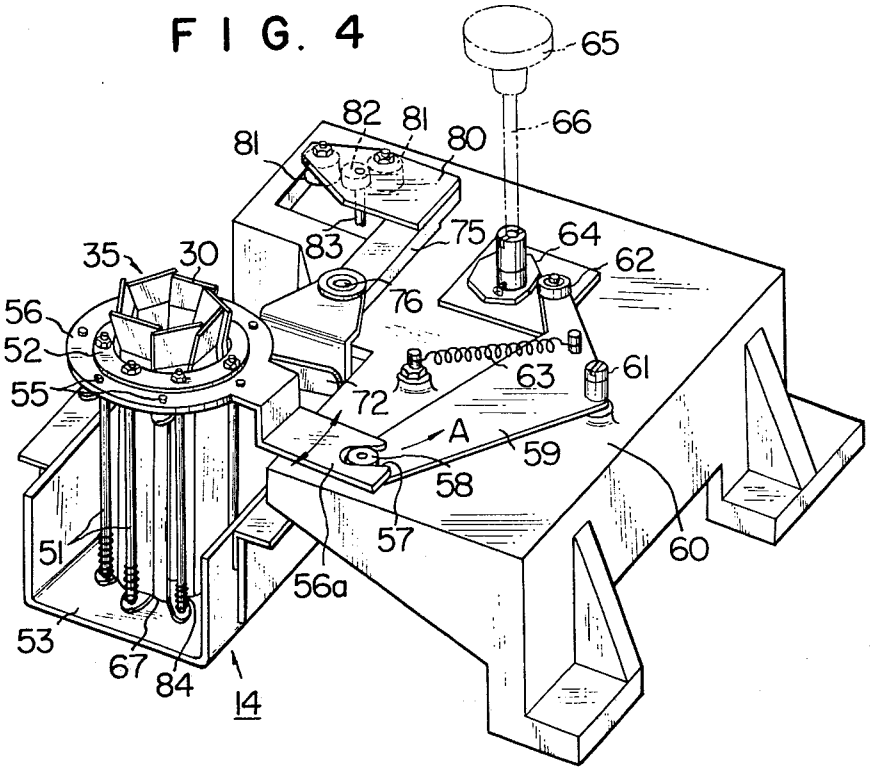
FIG. 4 is a perspective view of another preferred embodiment of the invention, showing a coin stacker together with means for imparting vibratory motion thereto and means for adjusting the diameter of the inscribed circle of the substantially regularly polygonal cross section of a hollow space in the coin stacker according to the denomination or the class of coins to be stacked therein.
Figure 5:
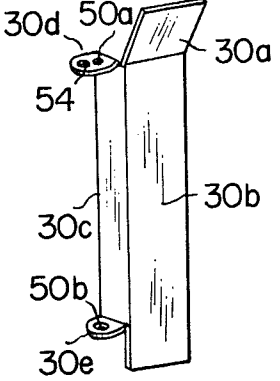
FIG. 5 is a perspective view showing in detail one of the coin guide members forming the coin stacker of FIG. 4.
Figure 6:
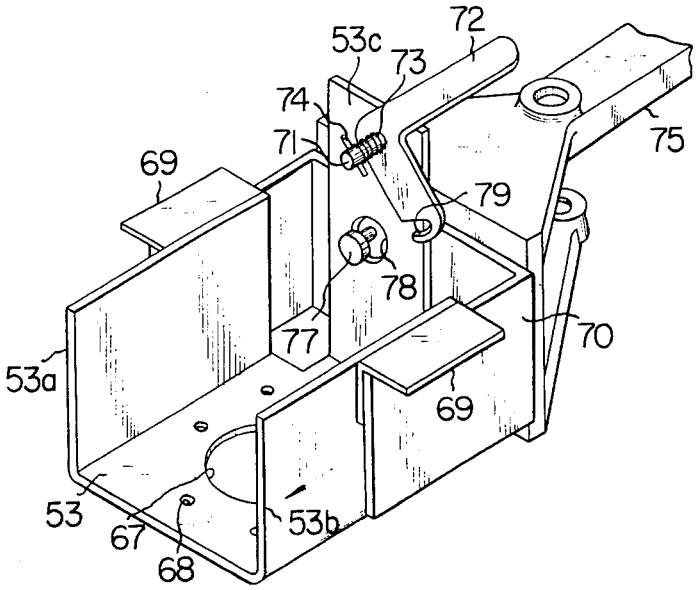
FIG. 6 is an enlarged perspective view showing in detail a mount of the coin stacker of FIG. 4 together with means for detachably supporting the same.

FIGS. 4, 5 and 6 illustrate another preferred embodiment of the invention. The coin stacker proper generally indicated by the numeral 14 in FIG. 4 includes a plurality, seven in this embodiment, of coin guide members 30. As illustrated in greater detail in FIG. 5, each of these coin guide members 30 has its upper portion 30*a* inclined outwardly to form a substantially funnel-shaped hopper 35 of FIG. 4. Vertical portions 30*b* of these coin guide members are used to define a substantially regularly heptagonal space in which the coins are stacked as hereinafter described in greater detail. Folded side portions 30*c* of the coin guide members are formed with flanges 30*d* and 30*e* having holes 50*a* and 50*b* therethrough for insertion of rods 51 as shown in FIG. 4. These rods 51 are fixedly supported by a stationary ring 52 and a mount 53. Slots 54 additionally formed in the upper flanges 30*d* of the coin guide members 30 loosely receive pins 55 which are fixedly planted on the rotatable annular member 56 under the stationary ring 52.

The rotatable annular member 56 is formed with a radial projection 56*a* having a slot or recess 57 on its end. Loosely received in this slot 57 is a roller 58 pivoted on one end of a lever 59. This lever is swingably supported on a frame 60 by a shaft 61 and has a cam follower 62 pivoted on the other end thereof. A coil spring 63 urges the cam follower 62 against a cam 64 adapted for adjustment of the diameter of the inscribed circle of the substantially regularly heptagonal cross section of the space defined by the coin guide members 30 according to the denomination or the class of coins to be stacked. The cam 64 may be coupled to a manually turnable knob 65 through a rod 66.

As illustrated in greater detail in FIG. 6, the aforesaid mount 53 is formed with a circular aperture 67 to permit the projection of the lower ends of the coin guide members 30 therethrough. Bores 68 around the circular aperture 67 are formed to accomodate the lower ends of the rods 51. Vertical portions 53*a* and 53*b* on both sides of the mount 53 are securely attached with substantally L-shaped lugs 69 resting on a substantially U-shaped holder 70. Another vertical portion 53*c* on the backward end of the mount 53 is fixedly provided with a shaft 71 to swingably support a lock lever 72. A helical compression spring 73 mounted between this lock lever 72 and a check pin 74 inserted crosswise into the shaft 71 keeps the lock lever in contact with the vertical portion 53*c* of the mount 53.

For imparting vibratory motion to the coin guide members 30, the holder 70 is coupled to a suitable source of vibration such as an electric motor, not shown, through a link 75 oscillatably supported by a pin 76 on the frame 60 of FIG. 4. A lock pin 77 is planted in the front end of the link 75 through the holder 70. By inserting this lock pin 77 into a suitably large bore 78 formed in the vertical portion 53*c* of the mount 53, and by succeedingly turning the lock lever 72 to engage the lock pin 77 with a slot 79 formed therein, the mount is secured to the holder 70 and hence to the link 75.

Referring back to FIG. 4, a member 80 is secured to the rear end of the link 75, while a pair of rollers 81 are mounted downwardly on the bottom of the member 80. A cam 82 eccentrically supported on an output shaft 83 of the source of vibration is positioned between the pair of rollers 81 while in contact therewith.

The aforesaid rods 51 extending between the stationary ring 52 and the mount 53 may be provided with torsion springs 84 each having one end hooked on the circular aperture 67 and the other end on the side edge of the adjacently situated coin guide members 30. In this manner it is possible to prevent undesired motion of the coin guide members 30 that may be caused due to the clearance between the slots 54 and the pins 55.

In order to adjust the diameter of the inscribed circle of the substantially regular heptagon defined by the coin guide members 30 in the above described second preferred embodiment of this invention, the cam 64 of FIG. 4 is turned to a position selected according to the denomination or the class of the coins to be stacked. The lever 59 is thus swung on its shaft 61 to its position corresponding to the denomination of the coins. The rotatable annular member 56 is also rotated through an angle corresponding to the angle of swing of the lever 59, so that the blades 30 are each turned through an equal angle on the rod 51 by the pin 55 fixedly planted on the rotatable annular member 56. In this manner it is possible to increase or decrease the area of the substantially regular heptagon defined by the coin guide members 30 in order to adjust the diameter of its incribed circle slightly greater than the diameter of the coins.

Figure 7A:
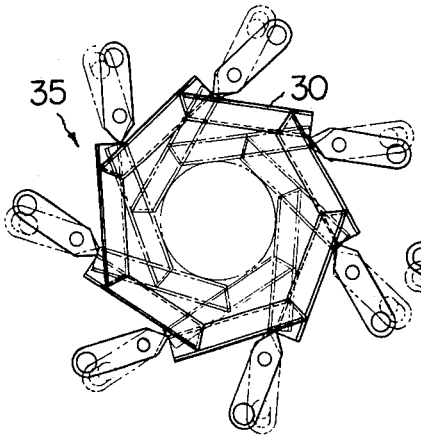
FIGS. 7(*a*) and 7(*b*) are plan views explanatory of the adjusting operation of the coin guide members forming the coin stackers of the invention.
Figure 7B:
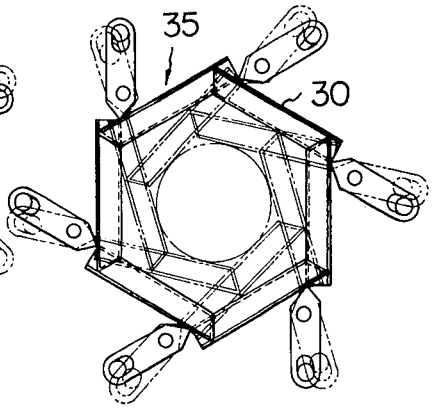

FIG. 7 illustrates how the substantially regularly polygonal cross sections of the coin guide members 30, combined in accordance with the FIGS. 4, 5 and 6 embodiment, are reduced in size from the state illustrated by the solid lines to that by the dot-and-dash lines.

In order to ensure the horizontal stacking of the coins within the coin guide members 30 of FIG. 4, suitable vibratory motion must be imparted to these coin guide members. To this end the aforesaid source of vibration is set in operation when the coins are being delivered into the substantially funnel-shaped hopper 35, as previously described with reference to FIG. 1. The resultant rotation of the cam 82 causes, through the pair of rollers 81 and the member 80, the link 75 to slightly oscillate on the pin 76. The coin guide members 30 on the mount 53 are thus suitably vibrated to send the successively supplied coins downwardly thereinto in a horizontal manner.

Although the vibratory motion thus imparted to the coin guide members 30 and hence to the rotatable annular member 56 is exercised through its projection 56*a* in the direction of the arrow A as indicated in FIG. 4, this vibratory motion is not substantially transmitted to the lever 59 to any appreciable degree because the slot 57 on the end of the projection 56*a* is suitably elongated in the direction of the arrow A. Thus, the coin guide members 30 are not displaced from their preadjusted positions in spite of the vibratory motion imparted to the coin guide members 30.

For removal of the coin stacker proper 14 for maintenance and other purposes, the lock lever 72 of FIG. 6 is turned out of engagement with the lock pin 77. In order to disengage the projection 56*a* of the rotatable annular member 56 from the rollr 58 of FIG. 4, the mount 53 is then slightly lifted relative to the holder 70, and succeedingly pulled forwardly.

Figure 8A:
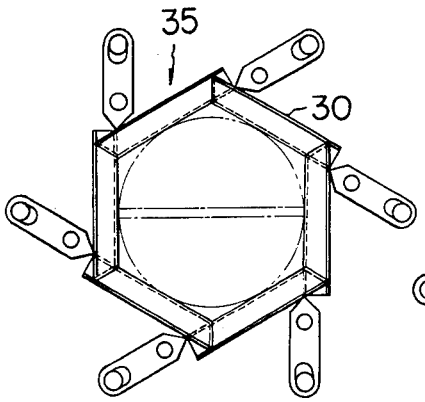
FIGS. 8(*a*) and 8(*b*) are plan views explanatory of the advantage of provision of an odd number of coin guide members.
Figure 8B:
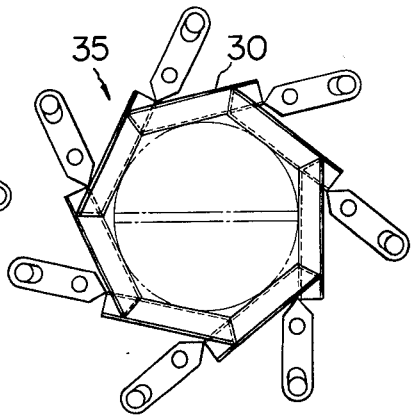

Both in the first and second preferred embodiments of the invention, it is desirable to provide as many coin guide members 30 as feasible in order to make their cross sectional shape close to a circle. Further, the provision of an odd number of coin guide members, as in the FIG. 4 embodiment, is preferable to that of an even number, as in the FIGS. 2 and 3 embodiment, for reasons hereinafter set forth with reference to FIG. 8.

Usually, the coins fall vertically into the polygonal space within the coin guide members 30 and are horizontally stacked on upon another only after reaching the bottom. When a coin stands at right angles with the two opposite sides of a substantially regularly hexagonal space defined by six coin guide members as shown in the upper part of FIG. 8, this coin will not be easily readjusted horizontally on the bottom. However, a coin standing at right angles with one side of a substantially regularly heptagonal space defined by seven coin guide members, as in the lower part of FIG. 8, has its opposite edge positioned at one of the angles. This latter coin will be easily readjusted horizontally on the bottom. As may now be apparent, the advantage of the provision of an odd number of coin guide members 30 resides in the fact that a coin falling axially in the space defined by these coin guide members need not contact the coin guide members on both sides thereof even when the diameter of the inscribed circle of the polygon is reduced substantially to the exact coin diameter.

Figure 9:
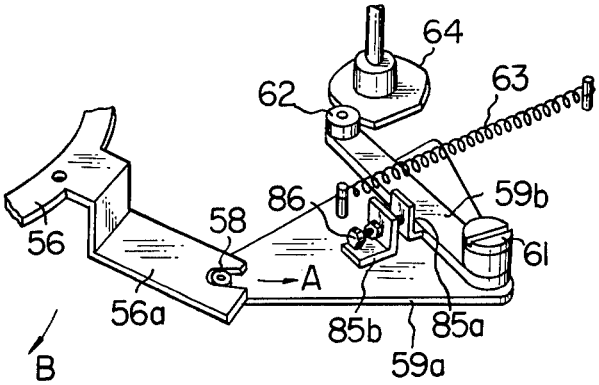
FIG. 9 is a perspective view of a still another embodiment of the invention.

FIG. 9 illustrates a third preferred embodiment of the invention, which in fact is a modification of the means for adjustment of the diameter of the inscribed circle of the substantially regular polygon defined by the coin guide members 30 in FIG. 4 embodiment. Instead of the single lever 59 in the preceding embodiment, there are provided levers 59*a* and 59*b*. A rollers 58 pivoted on one end of the lever 59*a* is associated with a rotatable annular member 56 in accordance with the FIG. 4 embodiment. However, a cam follower 62 pivoted on the free end of the lever 59*b* is kept in contact with the opposite side of a cam 64 by a coil spring 63 extending between the lever 59*a* and a frame not shown in this drawing. An upward projection 85*a* is formed on the mid-part of the lever 59*b*, whereas a similar upward projection 85*b* is formed on the lever 59*a* in face-to-face relationship with the upward projection 85*a*. An adjusting bolt 86 extends through these upward projections 85*a* and 85*b* for fine adjustment of the angle between the levers 59*a* and 59*b* according to the diameter of the coins to be stacked.

In this third embodiment of the invention, vibratory motion, if any, transmitted to the lever 59*a* in the direction of the arrow A will cause the cam follower 62 to move off the cam 64, so that the coin guide members 30 are less liable to be displaced from their preadjusted positions than those in the FIG. 4 embodiment. Further, the coin stacker proper in this third embodiment is easily removoble, by turning the lock lever 72 of FIG. 6 out of engagement with the lock pin 77 and by pulling the coin stacker proper in the direction of the arrow B in FIG. 9. Other details of construction and operation of this third embodiment are substantially as proviously described with reference to FIGS. 4, 5 and 6.

Although the present invention has been shown and described hereinbefore in terms of several preferred embodiments thereof, the invention, itself, is not considered to be restricted by the exact showing of the drawings and the description thereof. For example, the coin guide members 30 may be each suitable curved to form a substantially circular cross section when combined as in the examples herein disclosed. Further, while the annular members 56 is made rotatable relative to the ring 52 in the second preferred embodiment of the invention, it is, of course, possible to permit rotation of the latter relative to the former. All such modifications, substitutions and changes are intended in the foregoing disclosure. It is therefore appropriate that the appended claims be construed broadly and in a manner consistent with the fair meaning and the proper scope of the present invention.

I claim:

1. In a coin stacking device adapted for a coin wrapping apparatus in which coins fed from a coin supply passage are stacked at a coin stacking means comprising a plurality of coin guide members each of which has a coin guide surface and a diameter-adjusting means adapted for adjusting the inner diameter of a coin stacking space inscribed by said coin guide surfaces, a lower part of said coin stacking means being opened after a predetermined number of coins are stacked in said coin stacking space thereby to transmit said coin stack into a coin wrapping position and then the thus transmitted coin stock is wrapped with a wrapping sheet; the improvement of said coin stacking means and said diameter-adjusting means, said impro vement residing in that said coin guide surfaces of said coin stacking members are vertically elongated and mutually, partially, and mutual-slidably overlapped at their adjoining side wall positions so as to be mutually slid and to form therein an adjustable coin stacking space having a substantially polygonal cross-section, said coin stacking means comprising a coin-stack mounting means having a coin mounting surface adapted to open or close the bottom face of said coin stacking space and to mount thereon a coin stack stacked in said space when said bottom face is closed, said mounting surface being adapted to be moved along a lower part of said coin guide members so as to open the same to transfer a coin stack to the coin wrapping apparatus after a predetermined number of coins are stacked in said coin stacking space; and said diameter-adjusting means comprises a support means for adjustably supporting said coin guide surfaces of said coin guide members in parallel to the vertical-axis of said coin stacking space thereby to vary the diameter of the inscribed circle of said polygonal cross-section of said space so as to conform to the diameter of coins to be processed.

2. The device according to claim 1, wherein the number of said coin guide members is odd.

3. The device according to claim 1, in combination with means for imparting vibratory motion to said coin guide members in order to facilitate the neat stacking of the coins in said vertically elongated space.

4. The device according to claim 3, wherein said means for imparting vibratory motion to said coin guide members includes a cam mounted eccentrically on a shaft rotated by a driving means, at least a pair of rollers in contact with said cam, and an oscillatable link substantially integral with shafts supporting said rollers.

5. The device according to claim 4, wherein said oscillatable link includes a holder portion to which is detachably coupled a mount for said coin guide members and said support means.

6. The device according to claim 5, wherein said holder portion and said mount are provided with a lock pin and a lock lever, respectively, said lock lever being turnable to engage and disengage said lock pin.

7. In a coin stacking device adapted for a coin wrapping apparatus in which coins fed from a coin supply passage are stacked at a coin stacking means comprising a plurality of coin guide members each of which has a coin guide surface and a diameter-adjusting means adapted for adjusting the inner diameter of a coin stacking space inscribed by said coin guide surfaces, a lower part of said coin stacking means being opened after a predetermined number of coins are stacked in said coin stacking space thereby to transmit said coin stack into a coin wrapping position and then the thus transmitted coin stack is wrapped with a wrapping sheet; the improvement of said coin stacking means and said diameter-adjusting means, said improvement residing in that said coin guide surfaces of said coin stacking members are vertically elongated and mutually, partially, and mutual-slidably overlapped at their adjoining side wall positions so as to be mutually slid and to form therein an adjustable coin stacking space having a substantially polygonal cross-section, said coin stacking means comprising a coin-stack mounting means having a coin mounting surface adapted to open or close the bottom face of said coin stacking space and to mount thereon a coin stack stacked in said space when said bottom face is closed, said mounting surface being adapted to be moved along a lower part of sad coin guide members so as to open the same to transfer a coin stack to the coin wrapping apparatus after a predetermined number of coins are stacked in said coin stacking space; and said diameter-adjusting means comprises a support means for adjustably supporting said coin guide members and adapted to advance and retract said coin guide surfaces of said coin guide members in parallel to the vertical-axis of said coin stacking space thereby to vary the diameter of the inscribed circle of said polygonal cross-section of said space so as to conform to the diameter of coins to be processed, said diameter-adjusting means comprising at least one cam wheel having a central aperture surrounding the coin guide members, said central aperture being so shaped that when said cam wheel is rotated in a predetermined direction, the diameter of said inscribed circle is reduced.

8. A coin stacking device is claimed in claim 7, in which said cam wheel is provided with locking means for locking said cam wheel at its adjusted position, said locking means comprising a ratchet wheel having a central aperture through which said coin guide members extend with clearance, said ratchet wheel being coupled to said at least one cam wheel for simultaneous rotation therewith, and at least one clip engaged with said ratchet wheel to prevent the rotation of said at least one cam wheel in other than said predetermined direction.

9. The device as claimed in claim 7, in which said support means for adjustably supporting said coin guide members includes a stationary ring around said coin guide members, a plurality of rods each fixedly supported at one end thereof by said stationary ring and inserted into a pair of flanges projecting sidewardly from one side of each of said coin guide members to permit swinging motion thereof.

10. The device according to claim 9, wherein said support means further comprises a rotatable annular member around said coin guide members, and a plurality of pins each of which is inserted into an elongated slot formed in one of said flanges of each of said coin guide members and fixedly planted in said rotatable annular member, whereby when said rotatable annular member is rotated said coin guide members are turned at said rods to vary the diameter of the inscribed circle of said substantially polygonal cross section of said vertically elongated space.

11. The device according to claim 10, in which there is provided means for rotating said rotatable annular member through an angle predetermined according to the denomination of the coins.

12. The device according to claim 11, wherein said means for rotating said rotatable annular member includes a turnable cam having a contour formed according to various denominations of the coins, and a lever pivotally supported in the mid-part thereof and having a cam follower on one end thereof which is urged against said turnable cam, the other end of said lever being coupled to said rotatable annular member for rotating the same through angles determined by the cam contour.

13. The device according to claim 12, in which there is provided means for imparting vibratory motion to said coin guide members to facilitate neat stacking of the coins, and wherein said lever is coupled to said rotatable annular member through a roller which pivoted on said other end of said lever and loosely received in a slot formed in a radial projection of said rotatable annular member, said slot being elongated in the direction of the vibratory motion imparted to said coin guide members whereby the vibratory motion is not substantially transmitted to said lever.

14. The device according to claim 11, wherein said means for rotating said rotatable annular member includes a turnable cam having a contour formed according to various denominations of the coins, a first lever swingably supported at one end thereof and having a cam follower on the other end which is urged against said turnable cam, a second lever swingably supported at one end thereof on the same axis as said first lever and being coupled at the other end to said rotatable annular member for rotating the same through angles determined by the cam contour, and a screw-threaded member extending between said first and said second lever for adjustment of the angle therebetween.

15. The device according to claim 14, in which there is provided means for imparting vibratory motion to said coin guide members to facilitate neat stacking of the coins, and wherein said second lever is coupled to said rotatable annular member through a roller which is pivoted on said other end of said second lever and which is loosely received in a slot formed in a radial projection of said rotatable annular member, said slot being elongated in the direction of the vibratory motion imparted to said coin guide members whereby the vibratory motion is not substantially transmitted to said second lever.

* * * * *